United States Patent [19]

Stanojevic

[11] Patent Number: 4,906,913

[45] Date of Patent: Mar. 6, 1990

[54] LOW DROPOUT VOLTAGE REGULATOR WITH QUIESCENT CURRENT REDUCTION

[75] Inventor: Silvo Stanojevic, Milpitas, Calif.

[73] Assignee: National Semiconductor Corporation, Santa Clara, Calif.

[21] Appl. No.: 324,358

[22] Filed: Mar. 15, 1989

[51] Int. Cl.[4] ..... G05F 5/00

[52] U.S. Cl. ..... 323/303; 323/273

[58] Field of Search ..... 323/268, 269, 273, 274, 323/279, 280, 281, 303

[56] References Cited

U.S. PATENT DOCUMENTS 4,319,179 3/1982 Jett, Jr. ..... 323/281
4,560,918 12/1985 Callen ..... 323/273
4,613,809 9/1986 Skovmand ..... 323/273 X
4,792,747 12/1988 Schroeder ..... 323/303

*Primary Examiner*—Patrick R. Salce
*Assistant Examiner*—Kristine Peckman
*Attorney, Agent, or Firm*—Gail W. Woodward; Lee Patch; Michael A. Glenn

[57] ABSTRACT

A low dropout voltage regulator with quiescent current reduction has a pass transistor coupled for conduction from a positive supply terminal to a regulated output terminal. A first switch is coupled to conduct the base current of the pass transistor to the regulated output terminal. A second switch is coupled to conduct the base current of the pass transistor to ground. A control circuit selects the action of the switches to select the conduction path for base current.

17 Claims, 1 Drawing Sheet

LOW DROPOUT VOLTAGE REGULATOR WITH QUIESCENT CURRENT REDUCTION

BACKGROUND OF THE INVENTION

This invention relates to an improved form of electronic voltage regulator. A voltage regulator can be found in virtually every piece of electronic equipment. A voltage regulator has an input terminal and a ground terminal for connection to a source of input voltage, and operates to maintain a constant regulated output voltage at an output terminal.

A voltage regulator can be designed either as a positive voltage regulator or a negative voltage regulator. For convenience, this invention will be described as it relates to a positive voltage regulator, although it will be clear to one skilled in the art how to apply the invention to a negative regulator by appropriate reversal of voltage polarities and use of complementary transistor types.

In a positive voltage regulator, the input voltage $V_{IN}$ must be larger than the desired output voltage $V_{OUT}$, by an increment known as the "dropout voltage." If $V_{IN}$ is too low, the regulator will be unable to hold $V_{OUT}$ to the desired level. If $V_{IN}$ should then fall, $V_{OUT}$ must fall as well.

A low dropout voltage is important, for example, in battery powered equipment where it is desirable to maintain $V_{OUT}$ at its designed level for as long as possible as the battery voltage falls. In today's low dropout voltage regulators, the dropout voltage can be as low as 500 millivolts.

Quiescent current can be defined as that part of the current drawn from the input which does not appear in the current supplied at the regulated output. Quiescent current flows through the regulator circuitry to the ground terminal. Since the quiescent current does not contribute useful output, efforts are made to keep it low. A large quiescent current reduces the operating life of battery powered equipment. In other applications, a large quiescent current results in high power dissipation and overheating within the regulator. In today's low quiscent current regulators, the quiescent current can be as low as 50 milliamps at 500 milliamps of output current.

FIG. 1 shows a schematic of a low dropout and low quiescent current voltage regulator known in the art, which is described in U.S. Pat. No. 4,613,809 QUIESCENT CURRENT REDUCTION IN LOW DROPOUT REGULATORS, assigned to National Semiconductor Corporation, the teaching of which is incorporated herein by reference.

Referring to FIG. 1, the input voltage $V_{IN}$ is applied across input terminal 10 and ground terminal 11. The regulated output voltage $V_{OUT}$ appears at output terminal 12 due to the action of pass transistor 13 controlled by a driver transistor 14. The driver transistor 14 is activated by an error amplifier 16 which compares a reference voltage $V_{REF}$ 17 with the regulated output voltage $V_{OUT}$ reduced through a voltage divider of resistors 18 and 19.

Driver transistor 14 is specially constructed with two collectors 8 and 9. The first collector 8 encircles the emitter and base regions in the transistor, but is in turn encircled by the second collector 9. Further details of this special construction can be found in the above referenced patent. In normal operation, the first driver collector 8 conducts the base current from pass transistor 13 through a diode 15 to the regulated output terminal 12. In this way quiescent current is reduced since its major component, the base current of pass transistor 13, is returned to the regulated output terminal 12.

The second driver collector 9 comes into action as the input voltage $V_{IN}$ drops close to the regulated output voltage $V_{OUT}$. Conduction falls in pass transistor 13 and driver transistor 14 as the voltage difference across their terminals diminishes. At a low enough voltage, a transistor is said to be in saturation, because the voltage difference across its terminals is too low to maintain conduction across its junctions. The first driver collector 8 saturates first when it cannot maintain enough forward bias to conduct through diode 15 to the output terminal 12.

The saturation of the first driver collector 8 allows current to reach the outer, encircling second driver collector 9. Conduction will continue through second driver collector 9 since it is connected to ground, which is at a lower potential than the output terminal 12. This continued conduction allows the regulator to operate slightly longer, to a lower $V_{IN}$, before dropout occurs and $V_{OUT}$ must fall as well. Note however, that during this continued conduction, the benefits of quiescent current reduction are lost, since the current is conducted to ground, rather than returned to the output terminal 12.

The point at which saturation of the first collector 8 occurs and quiescent current increases as the second collector 9 begins to function can be analyzed as:

$$V_{IN}-V_{OUT}=V_{BE}13+V_{SAT}14+V_{DIODE}15$$

Where:

$V_{IN}$=Input voltage.

$V_{OUT}$=Regulated output voltage.

$V_{BE}$13=Base to emitter voltage drop of pass transistor 13.

$V_{SAT}$14=Saturation voltage of driver transistor 14.

$V_{DIODE}$15=Forward bias diode voltage drop of diode 15.

Since diode 15 could be constructed, for example, by a transistor base to emitter junction, both a transistor base to emitter drop or a diode voltage drop will be designated as a $V_{BE}$. The circuit of FIG. 1 therefore suffers from increased quiescent current at a $V_{IN}$ to $V_{OUT}$ difference of $2 * V_{BE}+V_{SAT}$.

It is desirable to continue quiescent current reduction to lower levels of $V_{IN}$, and to smaller $V_{IN}$ to $V_{OUT}$ differences, and to be able to tailor the level at which the path of conduction changes. It is also desirable to achieve this improved operation without being limited to the inherent fabrication characteristics of the specialized, dual collector construction of the driver transistor 14. It is also desirable to be able to provide multiple paths through which the pass transistor base current can be conducted.

SUMMARY OF THE INVENTION

It is an object of this invention to provide an improved form of low dropout voltage regulator with quiescent current reduction. It is also an object to extend quiescent current reduction to lower levels of $V_{IN}$ and to smaller $V_{IN}$ to $V_{OUT}$ differences. It is a further object to provide the ability to select the voltage difference at which the path of conduction for quiescent current reduction changes, and to be able to provide such conduction over multiple paths.

These and other objects are achieved as follows. A pass transistor is coupled for conduction from an input terminal to an output terminal. A first switch is coupled to conduct the base current of the pass transistor to the output terminal. A second switch is coupled to conduct the base current of the pass transistor to ground. A control circuit controls the action of the switches to select the conduction path for base current.

The first switch is normally selected, in order to provide quiescent current reduction via the conduction path to the output terminal. If the input voltage falls, the second switch is selected to provide the continued conduction to ground leading to low dropout. While both switches may be simultaneously selected, it is preferred to select only one switch at a time.

In a specific implementation, first and second PNP driver transistors are connected to the base of a PNP pass transistor. These driver transistors are controlled by the complementary outputs of an emitter coupled differential amplifier. The inputs of the differential amplifier monitor the difference between voltage references following the input voltage and output voltage.

In normal operation with a large difference from input voltage to the regulated output voltage, the first driver transistor is activated to return the pass transistor base current to the regulated output, thereby obtaining quiescent current reduction.

If the input voltage is lowered and dropout approaches, the differential amplifier switches to activate the second driver transistor to conduct the pass transistor base current to ground, thereby extending conduction to obtain a lower dropout voltage.

The differential amplifier can be biased and tailored to provide improved control of the point of switching of the conduction paths for base current. In a useful configuration, a first input to the differential amplifier monitors a voltage source adapted to follow the input voltage. A second input to the differential amplifier is coupled to the output voltage through a specific number of diode voltage drops, thereby tailoring the point at which the differential amplifier switches to select an alternate conduction path.

A specific circuit configuration allows the quiescent current reduction to continue to a lower input voltage by a level of one $V_{BE}$ below the level obtainable by the known prior art. This reduction in current can greatly improve the operating lifetime of battery powered equipment incorporating the voltage regulator circuit of the present invention.

DESCRIPTION OF THE PREFERRED EMBODIMENT

Figure 1:
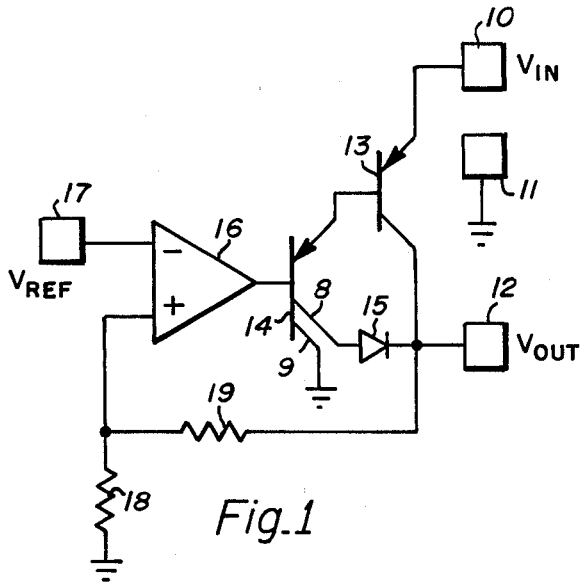
FIG. 1 shows a schematic of a low dropout and low quiescent current voltage regulator known in the art.
Figure 2:
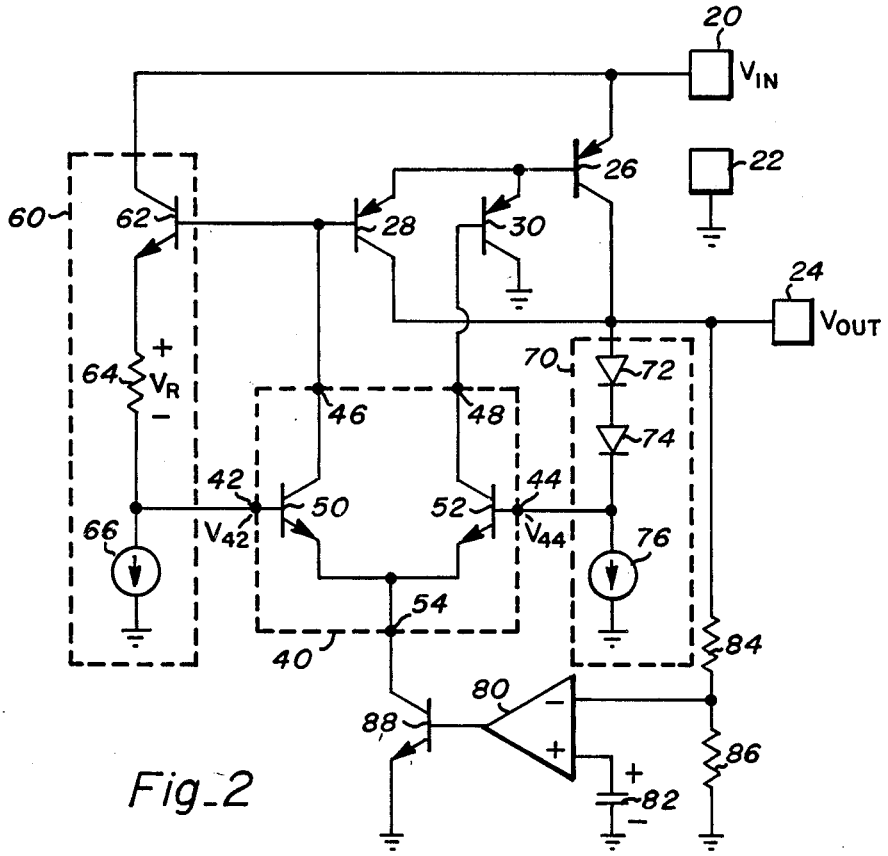
FIG. 2 shows a schematic of a low dropout voltage regulator with quiescent current reduction in accordance with the present invention.

FIG. 2 shows a schematic of a low dropout voltage regulator with quiescent current reduction in accordance with the present invention.

The input voltage $V_{IN}$ is applied across a positive supply or input terminal 20 and a negative supply or ground terminal 22 connected to the circuit ground. A regulated output voltage $V_{OUT}$ appears at an output terminal 24 due to conduction through a pass transistor 26.

In this positive regulator embodiment, the ground terminal can be connected to a positive or negative voltage, so long as it is maintained negative with respect to the voltage at the input terminal.

Pass transistor 26 is preferably a PNP type having an emitter, base, and collector, with emitter coupled to the input terminal 20, and collector coupled to the regulated output terminal 24. Pass transistor 26 preferably has a large power dissipation capability. In an specific implementation, pass transistor 26 could be a discrete transistor external to an integrated circuit containing the remaining circuitry.

A first driver transistor 28 functions as a first switch to couple the base of pass transistor 26 to the regulated output terminal 24. First driver transistor 28 is preferably of a PNP type having an emitter, base, and collector, with emitter coupled to the base of pass transistor 26, and collector coupled to the regulated output terminal 24.

A second driver transistor 30 functions as a second switch to couple the base of pass transistor 26 to ground. Second driver transistor 30 is preferably of a PNP type having an emitter, base, and collector, with emitter coupled to the base of pass transistor 26, and collector coupled to ground.

Many variations of these elements are possible. The PNP transistors can be replaced with other types, with accompanying suitable changes in polarity and circuit connections. Additional numbers of pass transistors can be used to increase power dissipation. Additional numbers of driver transistors connected to various circuit points can be used to provide additional conduction paths for the base current of the pass transistors.

Broadly, the remaining illustrated circuitry serves as a control circuit that monitors the input voltage $V_{IN}$ and the regulated output voltage $V_{OUT}$, and switches to select first driver transistor 28 or second driver transistor 30.

When the difference from the input voltage $V_{IN}$ to the regulated output voltage $V_{OUT}$ is well above the dropout voltage, the first driver transistor 28 and first conduction path for base current of the pass transistor 26 are activated. When the input voltage $V_{IN}$ falls close to the regulated output voltage $V_{OUT}$, the second driver transistor 30 and second conduction path for base current of the pass transistor 26 are activated.

A preferred implementation includes a differential amplifier 40 monitoring a first voltage reference 60 and a second voltage reference 70, and an error amplifier 80 monitoring the regulated output voltage $V_{OUT}$.

The differential amplifier 40 has a first input 42 and a second input 44, and complementary outputs with first output 46 and second output 48. The first input 42 is coupled to the first voltage reference 60. The second input 44 is coupled to the second voltage reference 70. The complementary first output 46 and second output 48 are coupled respectively to the base of the first driver transistor 28 and to the base of the second driver transistor 30.

The differential amplifier 40 is formed by an emitter coupled differential pair of transistors, with first transistor 50 being of an NPN type with a base serving as the first input 42, and a collector serving as the first output 46. Similarly, second transistor 52 is also of an NPN type with a base serving as the second input 44, and a collector serving as second output 48. The emitters of the differential pair of transistors 50 and 52 are coupled together and to a emitter current terminal 54 where is established an emitter current to be switched by the differential pair between the complementary outputs 46 and 48.

First voltage reference 60 is adapted to follow the input voltage $V_{IN}$. In particular, a suitable voltage reference 60 is formed by a transistor 62 and resistor 64. The transistor 62 will have a collector connected to the input voltage, a base connected two diode drops below the input voltage, such as from the base of driver transistor 28, and an emitter connected through resistor 64 to the first input 42 of the differential amplifier 40. In this way a biasing current flows from the input voltage through transistor 62 and resistor 64, causing a voltage drop across resistor 64. A small current sink 66 can be used to sink this biasing current to ground.

In operation, the first voltage reference 60 maintains the voltage level $V_{42}$ at the first input 42 of differential amplifier 40 at a voltage level below the input voltage $V_{IN}$ by three $V_{BE}$ drops plus the voltage drop $V_R$ across voltage drop resistor 64. Specifically, the voltage at first input 42 can be analyzed as:

$$V_{42}=V_{IN}-V_{BE}26-V_{BE}28-V_{BE}62-V_R$$

Where:

$V_{42}$=Voltage at first input 42 of differential amplifier 40.

$V_{IN}$=Input voltage at input terminal 20.

$V_{BE}$26=Base to emitter diode drop of pass transistor 26.

$V_{BE}$28=Base to emitter diode drop of pass transistor 28.

$V_{BE}$62=Base to emitter diode drop of pass transistor 62.

$V_R$=Voltage drop across voltage drop resistor 64.

Therefore by selection of the size of resistor 64, the voltage drop across it can be tailored in order to vary the voltage level $V_{42}$.

The second voltage reference 70 is adapted to follow the output voltage $V_{OUT}$ at the regulated output terminal 24. In particular, a suitable voltage reference can be formed by coupling the second input 44 of the differential amplifier through two series connected diodes 72 and 74 to the regulated output voltage $V_{OUT}$. These diodes are oriented to maintain the second input 44 at a voltage level of two forward biased diode voltage drops below the voltage level of the regulated output voltage $V_{OUT}$. In addition, a small current sink 76 can be used to maintain a biasing current through the two diode junctions 72 and 74.

In operation, the second voltage reference 70 maintains the voltage level $V_{44}$ at the second input 44 of differential amplifier 40 at a voltage level below the regulated output voltage $V_{OUT}$ by two diode voltage drops. Specifically, the voltage at second input 44 can be analyzed as:

$$V_{44}=V_{OUT}-V_{DIODE}72-V_{DIODE}74$$

Where:

$V_{44}$=Voltage at second input 44 of differential amplifier 40.

$V_{OUT}$=Regulated output voltage at output termianl 24.

$V_{DIODE}$72=Diode voltage drop across diode 72.

$V_{DIODE}$74=Diode voltage drop across diode 74.

When the voltage $V_{42}$ at the first input 42 of the differential amplifier 40 is higher than the voltage $V_{44}$ at the second input, then the first output 46 will be activated. When the voltage $V_{44}$ at the second input 44 of the differential amplifier 40 is higher than the voltage $V_{42}$ at the first input, then the second output 48 will be activated. For the circuit of FIG. 2 the input voltage $V_{IN}$ to output voltage $V_{OUT}$ difference at which this switching will occur can be analyzed as:

$$V_{IN}-V_{OUT}=V_{BE}26+V_{BE}28+V_{BE}62+V_R+-V_{BE}50-V_{BE}52-V_{DIODE}74-V_{DIODE}72$$

Assuming that all $V_{BE}$ and $V_{DIODE}$ drops are equal, this switching voltage can be approximated by:

$$V_{IN}-V_{OUT}=V_{BE}+V_R$$

In particular, to obtain a configuration in which quiescent current reduction is continued to a very low input voltage, the value of the voltage drop resistor 64 is set to obtain a voltage drop $V_R$ approximately equal to the saturation voltage of driver transistor 28. This provides operation with quiescent current reduction down to an input voltage to output voltage difference of $V_{BE}+V_{SAT}$. This is one $V_{BE}$ drop lower than the level that was available in the known prior art. Therefore, quiescent current reduction has been continued to a lower input voltage in the critical low input voltage range before regulation is lost due to dropout.

Selecting a value $V_R$ of voltage drop resistor 64 which provides a voltage drop less than the saturation voltage of driver transistor 28 does not provide quiescent current reduction to even lower input voltages. This is because at a difference of $V_{BE}+V_{SAT}$ driver transistor 28 will be in saturation and no further conduction through it can be supported. Therefore it is important to switch away from driver transistor 28 and select the alternate conduction path through driver transistor 30.

When the input voltage to output voltage difference drops below $V_{BE}+V_{SAT}$, the differential amplifier 40 will switch as described above, in order to activate the second driver transistor 30. Operation will then continue to conduct the base current of pass transistor 26 through second driver transistor 30 to ground. This continued conduction allows the regulator to operate slightly longer, to a lower input voltage, before dropout occurs and the output voltage must fall as well.

The error amp 80 is connected conventionally to compare a third voltage reference 82 to the regulated output voltage $V_{OUT}$ reduced through a voltage divider such as resistors 84 and 86. The output of error amp 80 is coupled to control the emitter current to be switched by the differential amplifier, for example, by coupling the output of the error amp 80 through a transistor 88 to the emitter current terminal 54 of the differential amplifier 40. In this way, the control providing by the error amp 80 is combined with the differential amplifier 40 to activate the driver transistors. Of course, the error amp 80 could provide its control independently to the driver transistors.

In operation, should the regulated output voltage $V_{OUT}$ fall, the error amp 80 will operate to increase the emitter current flowing through differential amplifier 40 and activating one of the driver transistors 28 and 30 in order to increase the conduction of pass transistor 26 and raise the regulated output voltage $V_{OUT}$.

In this described embodiment, a configuration has been described which allows quiescent current reduction to a lower input voltage as compared to the prior art. Clearly, the described voltage references could be modified to provide switching of the driver transistors at other voltage levels. Another alternative would switch when the input voltage has dropped below a specific level, rather than using a differential amplifier to detect voltage differences.

In other alternative embodiments, different methods of establishing the voltage references can be used. Several references and switching threshold could be set in order to optimized operation in each of several voltage ranges. Further, it should be clear that other alternatives could be developed which recognize certain other operating conditions and take appropriate switching actions.

Changes and modifications in the specifically described embodiments can be made without departing from the scope of the invention which is intended to be limited only by the scope of the following claims.

I claim:

1. A voltage regulator circuit having an input terminal, a ground and an output terminal, said circuit comprising:

a pass transistor having emitter, base and collector electrodes with the emitter coupled to the input terminal and the collector coupled to the output terminal;

a first switch for coupling the pass transistor base to the output terminal;

a second switch for coupling the pass transistor base to ground; and a differential amplifier having a first input coupled to said input terminal, a second input coupled to said output terminal and an output coupled to said first and second switches whereby said differential amplifier operates to activate said first and second switches as a function of the regulator input-output voltage differential.

2. A voltage regulator circuit as recited in claim 1 wherein the first switch comprises a driver transistor coupled from the pass transistor base to the output terminal.

3. A voltage regulator circuit as recited in claim 1 wherein the second switch comprises a driver transistor coupled from the pass transistor base to ground.

4. A voltage regulator as recited in claim 1 wherein the differential amplifier first input, is coupled to the input terminal via a voltage source connected to follow the voltage of the input terminal.

5. A voltage regulator as in claim 1 wherein the differential amplifier second input is coupled to the output terminal via two series connected diodes.

6. A voltage regulator as in claim 1 wherein the differential amplifier further includes complementary first and second outputs coupled respectively to control said first and second switches.

7. A low dropout voltage regulator with quiescent current reduction having positive and negative supply terminals for connection to a source of operating voltage, and having a regulated output terminal, comprising:

a pass transistor with emitter, base, and collector, with emitter coupled to said positive supply terminal and collector coupled to said regulated output terminal;

a first driver coupling said pass transistor base to said regulated output terminal;

a second driver coupling said pass transistor base to said negative supply terminal;

an emitter coupled differential amplifier with first and second inputs, and complementary first and second outputs, with complementary first and second outputs connected to activate respectively said first and second drivers.

a first voltage source connected to said differential amplifier first input;

a second voltage source connected to said differential amplifier second input;

an error amplifier with first and second inputs and an output, with first input coupled to said regulated output terminal, with second input coupled to a voltage reference, and with output coupled to control the emitter current flowing in said emitter coupled differential amplifier.

8. A low dropout volt regulator with quiescent current reduction as in claim 7 wherein said pass transistor is a PNP type.

9. A low dropout voltage regulator with quiescent current reduction as in claim 7 wherein said first and second drivers each comprise a PNP transistor.

10. A low dropout voltage regulator with quiescent current reduction as in claim 7 wherein said first voltage source is connected to follow the voltage of the positive supply terminal.

11. A low dropout voltage regulator with quiescent current reduction as in claim 7 wherein said second voltage source is connected to follow the voltage of the regulated output terminal.

12. A low dropout voltage regulator with quiescent current reduction as in claim 11 wherein said second voltage source is coupled to the regulated output terminal via two series connected diodes junctions.

13. A low dropout voltage regulator with quiescent current reduction having positive and negative supply terminals for connection to a source of operating voltage, and having a regulated output terminal, comprising:

a PNP pass transistor with emitter coupled to said positive supply terminal, and collector coupled to said regulated output terminal;

a first PNP driver transistor with emitter coupled to said pass transistor base, and with collector coupled to said regulated output terminal;

a second PNP driver transistor with emitter coupled to said pass transistor base, and with collector coupled to said negative supply terminal;

a first NPN transistor of an emitter coupled differential pair with base coupled to a first voltage reference connected to follow the voltage of the positive supply terminal, and collector coupled to said first driver transistor base;

a second NPN transistor of the emitter coupled differential pair with base coupled to a second voltage reference connected to follow the voltage of the regulated output terminal, and collector coupled to said second driver transistor base; an error amplifier with inverting and non-inverting inputs, and an output, with said inverting input coupled to said regulated output terminal, and with said non-inverting input coupled to a third voltage reference, and with said output coupled to emitters of said first and second transistors of an emitter coupled differential pair.

14. A low dropout voltage regulator as recited in claim 13 further comprising alternate conduction paths with selected voltage drop coupled from the positive supply terminal to the regulated output terminal.

15. A method of operating a voltage regulator between an input terminal and ground, with an output terminal, comprising the steps of:

creating a conducting path between the input terminal and output terminal by a pass transistor;

conducting said pass transistor base current through a driver transistor to the output terminal;

connecting inputs of a differential amplifier between the input terminal and the output terminal for detecting a reduced voltage differential from said input terminal to said output terminal; and conducting said pass transistor base current to ground as a result of said detecting step.

16. A method of operating a low dropout voltage regulator with quiescent current reduction between poaitive and negative supply terminals, with a regulated output terminal comprising the steps of:

creating a conducting path from the positive supply terminal to the regulated output terminal by a pass transistor;

controlling base current of the pass transistor by a driver transistor;

activating a first path for said base current of the pass transistor to the regulated output terminal;

coupling inputs of a differential amplifier between the positive supply terminal and the regulated output terminal for detecting a reduced difference of positive supply terminal to regulated output terminal voltage; and activating a second path for said base current of the pass transistor to the negative supply terminal as a result of the detecting step.

17. A method of operating a low dropout voltage regulator as recited in claim 14 further comprising maintaining an alternate conduction path of selected voltage drop coupled from the positive supply terminal to the regulated output terminal.

* * * * *